US007967510B2

(12) United States Patent
Martuch

(10) Patent No.: US 7,967,510 B2
(45) Date of Patent: Jun. 28, 2011

(54) FLEXIBLE CONTAINER FOR POURABLE PRODUCT

(75) Inventor: Thomas J. Martuch, Augusta, MI (US)

(73) Assignee: Kellogg Company, Battle Creek, MI (US)

( * ) Notice: Subject to any disclaimer, the term of this patent is extended or adjusted under 35 U.S.C. 154(b) by 993 days.

(21) Appl. No.: 11/835,623

(22) Filed: Aug. 8, 2007

(65) Prior Publication Data

US 2008/0037913 A1 Feb. 14, 2008

Related U.S. Application Data

(60) Provisional application No. 60/821,746, filed on Aug. 8, 2006.

(51) Int. Cl.

| | |
|---|---|
| ***B65D 33/00*** | (2006.01) |
| ***B65D 33/16*** | (2006.01) |
| ***B65D 65/26*** | (2006.01) |
| ***B65D 75/00*** | (2006.01) |
| ***B65D 75/58*** | (2006.01) |

(52) U.S. Cl. .... 383/207; 383/66; 229/87.05; 229/87.08; 426/122

(58) Field of Classification Search ..... 383/66, 383/207–209; 229/87.05, 87.08; 426/122, 426/123

See application file for complete search history.

(56) References Cited

U.S. PATENT DOCUMENTS

| | | | | |
|---|---|---|---|---|
| 2,684,807 | A * | 7/1954 | Gerrish | 383/206 |
| 2,951,765 | A * | 9/1960 | Robson | 426/113 |
| 3,012,894 | A * | 12/1961 | Nagel | 426/113 |
| 3,114,643 | A * | 12/1963 | Boston et al. | 426/113 |
| 3,186,628 | A * | 6/1965 | Rohde | 383/209 |
| 3,362,615 | A * | 1/1968 | Rodda, Jr. | 229/87.05 |
| 3,379,364 | A * | 4/1968 | Pilger | 229/87.05 |
| 3,404,988 | A * | 10/1968 | Rausing | 426/115 |
| 3,790,744 | A | 2/1974 | Bowen | |
| 3,909,582 | A | 9/1975 | Bowen | |
| 4,139,643 | A | 2/1979 | Hix et al. | |
| 4,292,332 | A * | 9/1981 | McHam | 426/111 |
| 4,546,884 | A | 10/1985 | Kuchenbecker | |
| 4,609,107 | A | 9/1986 | Martin et al. | |
| 4,740,163 | A | 4/1988 | Kuchenbecker | |
| 4,762,514 | A | 8/1988 | Yoshida | |
| 4,816,015 | A | 3/1989 | Holder et al. | |
| 4,838,429 | A * | 6/1989 | Fabisiewicz et al. | 383/205 |
| 4,874,096 | A * | 10/1989 | Tessera-Chiesa | 383/5 |

(Continued)

FOREIGN PATENT DOCUMENTS

EP 0473517 A2 3/1992

(Continued)

*Primary Examiner* — Jes F Pascua
(74) *Attorney, Agent, or Firm* — Dickinson Wright PLLC

(57) ABSTRACT

A flexible container for containing a quantity of pourable product is disclosed herein. The flexible container includes a bag having a first closed end and a second closed end and a wall extending between the first closed end and the second closed end to define a closed cavity. The flexible container also includes a tearable score line defining an intended opening directly to the closed cavity. The tearable score line divides the wall into a first portion engaged with both of the first closed end and the second closed end and a second portion spaced from both of the first closed end and the second closed end. The tearable score line is exposed and directly graspable such that the bag is operable to function as a dish when the second portion is removed.

12 Claims, 1 Drawing Sheet

U.S. PATENT DOCUMENTS

| | | | | |
|---|---|---|---|---|
| 4,890,759 | A | 1/1990 | Scanga et al. | |
| 4,951,836 | A | 8/1990 | Yoshimura et al. | |
| 5,029,712 | A | 7/1991 | O'Brien et al. | |
| 5,125,211 | A | 6/1992 | O'Brien et al. | |
| 5,158,499 | A | 10/1992 | Guckenberger | |
| 5,174,658 | A | 12/1992 | Cook et al. | |
| 5,205,479 | A | 4/1993 | Rice et al. | |
| 5,318,499 | A | 6/1994 | Rice et al. | |
| 5,326,023 | A | 7/1994 | Rice et al. | |
| 5,333,729 | A | 8/1994 | Wolfe | |
| 5,376,392 | A | 12/1994 | Ikegami et al. | |
| 5,443,154 | A | 8/1995 | Hustad et al. | |
| 5,494,215 | A | 2/1996 | Drummond et al. | |
| 5,529,224 | A | 6/1996 | Chan et al. | |
| 5,547,451 | A | 8/1996 | Drummond et al. | |
| 5,579,989 | A | 12/1996 | Roy et al. | |
| 5,630,308 | A | 5/1997 | Guckenberger | |
| 5,632,134 | A | 5/1997 | Noel et al. | |
| 5,688,463 | A | 11/1997 | Robichaud et al. | |
| 5,692,837 | A | 12/1997 | Beer | |
| 5,783,266 | A | 7/1998 | Gehrke | |
| 5,810,706 | A | 9/1998 | McDonald et al. | |
| 5,820,017 | A | 10/1998 | Eliovson et al. | |
| 5,826,752 | A | 10/1998 | Latimer | |
| 5,874,155 | A | 2/1999 | Gehrke et al. | |
| 5,934,809 | A | 8/1999 | Marbler | |
| 5,937,617 | A | 8/1999 | Yeager | |
| 5,996,845 | A | 12/1999 | Chan | |
| 6,007,246 | A | 12/1999 | Kinigakis et al. | |
| 6,010,001 | A | 1/2000 | Osborn, III | |
| 6,062,470 | A | 5/2000 | Robichaud | |
| 6,073,833 | A | 6/2000 | Desrosiers et al. | |
| 6,074,097 | A | 6/2000 | Hayashi et al. | |
| 6,076,969 | A | 6/2000 | Jaisle et al. | |
| 6,077,551 | A * | 6/2000 | Scrimager | 426/107 |
| 6,082,897 | A | 7/2000 | Galomb | |
| 6,098,874 | A | 8/2000 | Tokarski | |
| 6,120,860 | A | 9/2000 | Bowen et al. | |
| 6,126,975 | A | 10/2000 | Archibald et al. | |
| 6,131,736 | A | 10/2000 | Farris et al. | |
| 6,132,089 | A | 10/2000 | Galomb et al. | |
| 6,132,780 | A | 10/2000 | Archibald et al. | |
| 6,139,187 | A | 10/2000 | Galomb et al. | |
| 6,148,587 | A | 11/2000 | McDonald et al. | |
| 6,173,554 | B1 | 1/2001 | Marbler | |
| 6,207,925 | B1 | 3/2001 | Kendall | |
| 6,231,235 | B1 | 5/2001 | Galomb et al. | |
| 6,234,676 | B1 | 5/2001 | Galomb et al. | |
| 6,237,760 | B1 | 5/2001 | Parker et al. | |
| 6,241,646 | B1 | 6/2001 | Tokarski | |
| 6,245,367 | B1 | 6/2001 | Galomb | |
| 6,254,273 | B1 | 7/2001 | Galomb et al. | |
| 6,254,907 | B1 | 7/2001 | Galomb | |
| 6,257,763 | B1 | 7/2001 | Stolmeier et al. | |
| 6,267,243 | B1 | 7/2001 | Sumpmann et al. | |
| 6,273,607 | B1 | 8/2001 | Buchman | |
| 6,273,608 | B1 | 8/2001 | Ward, Jr. et al. | |
| 6,290,390 | B1 | 9/2001 | Buchman | |
| 6,290,391 | B1 | 9/2001 | Buchman | |
| 6,296,388 | B1 | 10/2001 | Galomb et al. | |
| 6,299,607 | B1 | 10/2001 | Osborn, III et al. | |
| 6,328,203 | B1 | 12/2001 | Tedford, Jr. | |
| 6,347,885 | B1 | 2/2002 | Buchman | |
| 6,352,364 | B1 | 3/2002 | Mobs | |
| 6,360,513 | B1 | 3/2002 | Strand et al. | |
| 6,383,592 | B1 | 5/2002 | Lowry et al. | |
| 6,390,676 | B1 | 5/2002 | Colombo et al. | |
| 6,394,340 | B1 | 5/2002 | Anchor et al. | |
| 6,415,939 | B1 | 7/2002 | Redmond | |
| 6,419,152 | B1 | 7/2002 | Tokarski | |
| 6,427,420 | B1 | 8/2002 | Olivieri et al. | |
| 6,446,860 | B1 | 9/2002 | Robichaud | |
| 6,454,692 | B2 | 9/2002 | Ganneval et al. | |
| 6,460,759 | B1 | 10/2002 | Lowry et al. | |
| 6,464,394 | B1 | 10/2002 | Galomb | |
| 6,467,956 | B1 | 10/2002 | Tilman et al. | |
| 6,474,866 | B2 | 11/2002 | Buchman | |
| 6,502,986 | B1 | 1/2003 | Bensur et al. | |
| 6,517,242 | B1 | 2/2003 | Buchman | |
| 6,517,243 | B2 | 2/2003 | Huffer et al. | |
| 6,524,002 | B2 | 2/2003 | Tomic | |
| 6,530,870 | B2 | 3/2003 | Buchman et al. | |
| 6,554,135 | B1 | 4/2003 | Luceri et al. | |
| 6,558,306 | B2 | 5/2003 | Lowry et al. | |
| 6,572,266 | B2 | 6/2003 | Buchman | |
| 6,588,177 | B1 | 7/2003 | Melchoir | |
| 6,595,353 | B1 | 7/2003 | Focke et al. | |
| 6,601,370 | B2 | 8/2003 | Colombo et al. | |
| 6,609,999 | B2 | 8/2003 | Albright | |
| 6,610,338 | B2 | 8/2003 | Tang | |
| 6,652,436 | B1 | 11/2003 | Yeager et al. | |
| 6,660,983 | B2 * | 12/2003 | Monforton et al. | 219/727 |
| 6,675,558 | B2 | 1/2004 | Kinigakis et al. | |
| 6,685,058 | B2 | 2/2004 | Redmond | |
| 6,688,079 | B2 | 2/2004 | Kinigakis et al. | |
| 6,688,080 | B2 | 2/2004 | Kinigakis et al. | |
| 6,688,515 | B1 | 2/2004 | Huffman et al. | |
| 6,705,467 | B1 | 3/2004 | Kancsar et al. | |
| 6,709,157 | B2 | 3/2004 | VandenHeuvel et al. | |
| 6,719,678 | B1 | 4/2004 | Stern | |
| 6,726,363 | B1 | 4/2004 | Marbler et al. | |
| 6,746,743 | B2 | 6/2004 | Knoerzer et al. | |
| 6,766,941 | B1 | 7/2004 | Tokarski | |
| 6,769,229 | B2 | 8/2004 | Kinigakis et al. | |
| 6,811,027 | B2 | 11/2004 | Alexander | |
| 6,820,393 | B2 | 11/2004 | Kinigakis et al. | |
| 6,820,745 | B1 | 11/2004 | Ono et al. | |
| 6,823,647 | B2 | 11/2004 | Kinigakis et al. | |
| 6,829,873 | B2 | 12/2004 | Kinigakis et al. | |
| 6,843,600 | B2 | 1/2005 | Tilman et al. | |
| 6,845,598 | B1 | 1/2005 | Melchoir | |
| 6,860,843 | B2 | 3/2005 | Hayashi et al. | |
| 6,863,646 | B2 | 3/2005 | Kinigakis et al. | |
| 6,866,420 | B2 | 3/2005 | Buchman | |
| 6,874,935 | B2 | 4/2005 | Edelman et al. | |
| 6,880,973 | B2 | 4/2005 | Schneider et al. | |
| 6,884,207 | B2 | 4/2005 | Pokusa | |
| 6,892,876 | B1 | 5/2005 | Aubry et al. | |
| 6,910,806 | B2 | 6/2005 | Strand et al. | |
| 6,913,387 | B2 | 7/2005 | Strand et al. | |
| 6,929,128 | B2 | 8/2005 | Caldwell et al. | |
| 6,935,996 | B2 | 8/2005 | Stern | |
| 6,939,041 | B2 | 9/2005 | Kinigakis et al. | |
| 6,945,922 | B2 | 9/2005 | Baggot et al. | |
| 6,948,848 | B2 | 9/2005 | Ausnit | |
| 6,951,999 | B2 * | 10/2005 | Monforton et al. | 219/727 |
| 6,957,763 | B2 | 10/2005 | Huffman et al. | |
| 6,971,794 | B2 | 12/2005 | Yeager | |
| 6,974,256 | B2 | 12/2005 | Kinigakis et al. | |
| 6,983,576 | B2 | 1/2006 | Ono et al. | |
| 6,986,377 | B2 | 1/2006 | Johnson et al. | |
| 6,988,828 | B2 | 1/2006 | Linneweil | |
| 6,994,470 | B2 | 2/2006 | Galomb | |
| 7,717,620 | B2 * | 5/2010 | Hebert et al. | 383/203 |
| 2001/0017947 | A1 | 8/2001 | Strand et al. | |
| 2001/0017950 | A1 | 8/2001 | Strand et al. | |
| 2001/0019989 | A1 | 9/2001 | Ganneval et al. | |
| 2001/0030192 | A1 | 10/2001 | Redmond | |
| 2001/0053253 | A1 | 12/2001 | Buchman et al. | |
| 2002/0015537 | A1 | 2/2002 | Strand et al. | |
| 2002/0040213 | A1 | 4/2002 | Tweddell, III et al. | |
| 2002/0068668 | A1 | 6/2002 | Chow et al. | |
| 2002/0154835 | A1 | 10/2002 | Galomb | |
| 2002/0196987 | A1 | 12/2002 | Tilman et al. | |
| 2003/0002753 | A1 | 1/2003 | Stolmeier et al. | |
| 2003/0019780 | A1 | 1/2003 | Parodi et al. | |
| 2003/0041563 | A1 | 3/2003 | Schneider et al. | |
| 2003/0044491 | A1 * | 3/2003 | Monforton et al. | 426/107 |
| 2003/0051440 | A1 | 3/2003 | Chow et al. | |
| 2003/0054931 | A1 | 3/2003 | Buchman et al. | |
| 2003/0072502 | A1 | 4/2003 | Strand et al. | |
| 2003/0077010 | A1 | 4/2003 | Schulz | |
| 2003/0113415 | A1 | 6/2003 | Strand et al. | |
| 2003/0116614 | A1 | 6/2003 | Block et al. | |
| 2003/0124294 | A1 | 7/2003 | Hodson et al. | |
| 2003/0127352 | A1 | 7/2003 | Buschkiel et al. | |
| 2003/0172622 | A1 | 9/2003 | Kinigakis et al. | |

2003/0185468 A1 10/2003 Keith et al.
2003/0198407 A1 10/2003 Rehwinkel et al.
2003/0203799 A1 10/2003 VandenHeuvel et al.
2003/0215163 A1 11/2003 Schneider et al.
2003/0219173 A1 11/2003 Schneider
2003/0219176 A1 11/2003 Kocher et al.
2003/0223656 A1* 12/2003 Razeti et al. ..... 383/66
2003/0231811 A1 12/2003 Hodson et al.
2004/0026423 A1 2/2004 Cappel et al.
2004/0035719 A1 2/2004 Ebbers et al.
2004/0038792 A1 2/2004 Albright
2004/0058039 A1 3/2004 Strand et al.
2004/0060974 A1 4/2004 Dacey
2004/0086207 A1 5/2004 Marbler et al.
2004/0089577 A1 5/2004 Kancsar et al.
2004/0109618 A1 6/2004 Marbler et al.
2004/0114838 A1 6/2004 McGregor
2004/0118839 A1 6/2004 Hughes et al.
2004/0118904 A1 6/2004 Versluys
2004/0134166 A1 7/2004 Ausnit
2004/0141664 A1 7/2004 Olsen et al.
2004/0146226 A1 7/2004 Wolak et al.
2004/0208400 A1 10/2004 Linneweil
2004/0228547 A1 11/2004 Hartzell et al.
2005/0008268 A1 1/2005 Plourde et al.
2005/0016125 A1 1/2005 Kinigakis et al.
2005/0016134 A1 1/2005 Prebelli et al.
2005/0017007 A1 1/2005 Sellari et al.
2005/0025392 A1 2/2005 Stolmeier
2005/0025395 A1 2/2005 Howell et al.
2005/0029267 A1 2/2005 Martin et al.
2005/0031228 A1 2/2005 Galomb et al.
2005/0031232 A1 2/2005 Jammet et al.
2005/0041889 A1 2/2005 Scarberry
2005/0050851 A1 3/2005 Osgood
2005/0053315 A1 3/2005 Aasen
2005/0061701 A1 3/2005 Osgood
2005/0063617 A1 3/2005 Tilman
2005/0063619 A1 3/2005 Kinigakis et al.
2005/0103681 A1 5/2005 Aubry et al.
2005/0123218 A1 6/2005 Pokusa
2005/0132668 A1 6/2005 Ausnit
2005/0135710 A1 6/2005 Melchoir
2005/0137073 A1 6/2005 Weaver
2005/0150785 A1 7/2005 Julius et al.
2005/0150891 A1 7/2005 Schalk et al.
2005/0160700 A1 7/2005 Zumbiel et al.
2005/0178087 A1 8/2005 Melchoir
2005/0184070 A1 8/2005 Boback et al.
2005/0187089 A1 8/2005 Schneider et al.
2005/0189353 A1 9/2005 Padovani
2005/0194282 A1 9/2005 Kraimer et al.
2005/0199521 A1 9/2005 Givens, Jr.
2005/0226542 A1 10/2005 Kendall et al.
2005/0252176 A1 11/2005 Pritchard
2005/0254731 A1 11/2005 Berbert et al.
2005/0276521 A1 12/2005 Price
2005/0276525 A1 12/2005 Hebert et al.
2005/0284776 A1 12/2005 Kobayashi et al.
2005/0284789 A1 12/2005 Carespodi
2006/0014616 A1 1/2006 Baggot et al.
2006/0021296 A1 2/2006 Yeager
2006/0027483 A1 2/2006 Aldridge
2006/0034551 A1 2/2006 Linneweil
2009/0255847 A1* 10/2009 Motsch et al. ..... 206/581

FOREIGN PATENT DOCUMENTS

EP 0540184 A1 5/1993
JP 04044968 A * 2/1992
JP 2002002805 A * 1/2002

* cited by examiner

FLEXIBLE CONTAINER FOR POURABLE PRODUCT

CROSS-REFERENCE TO RELATED APPLICATION

This application claims the benefit of U.S. Provisional Patent Application Ser. No. 60/821,746 for a FLEXIBLE CONTAINER FOR POURABLE PRODUCT, filed on Aug. 8, 2006, which is hereby incorporated by reference in its entirety.

BACKGROUND OF THE INVENTION

1. Field of the Invention

The inventions relate to a flexible container for containing a quantity of pourable product, such as a bag or pouch or sack, having a removable portion for defining an intended opening.

2. Description of the Related Art

Packages constructed from flexible materials such as laminates can be used to contain products that are pourable, such as liquids and powders. Other examples of the pourable products contained in packages constructed from flexible materials include discrete masses packaged, such as food products, plastic pellets, and gravel. With respect to pourable, edible products, at least some are placed in hermetically sealed pouches to preserve their freshness. These packages can include an opening for gaining access to the package interior. The opening can be defined by a portion of the package that is removed from the rest of the packaged. The "removed" portion can be engaged with the rest of the package along a score line or "line of weakness."

SUMMARY OF THE INVENTION

In summary, the invention is a flexible container for containing a quantity of pourable product. The flexible container includes a bag having a first closed end and a second closed end and a wall extending between the first closed end and the second closed end to define a closed cavity. The flexible container also includes a tearable score line defining an intended opening directly to the closed cavity. The tearable score line divides the wall into a first portion engaged with both of the first closed end and the second closed end and a second portion spaced from both of the first closed end and the second closed end. The tearable score line is exposed and directly graspable such that the bag is operable to function as a dish when the second portion is removed.

BRIEF DESCRIPTION OF THE DRAWINGS

Numerous applications of the invention are possible and a plurality of exemplary flexible containers are described below for consideration in conjunction with the following drawings.

DETAILED DESCRIPTION OF EXEMPLARY EMBODIMENTS

Figure 1:
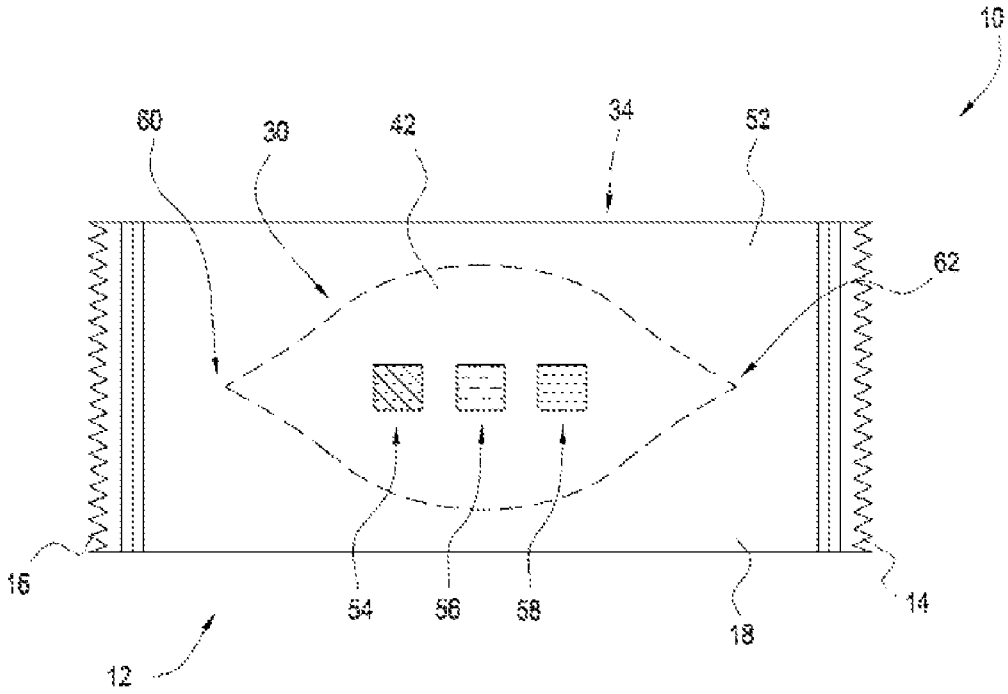
FIG. 1 is a top view of a flexible container according to a first embodiment of the invention.

A plurality of different flexible containers are shown in the Figures of the application. Similar features are shown in the various flexible containers. Similar features have been numbered with a common reference numeral and have been differentiated by an alphabetic designation. Also, to enhance consistency, features in any particular drawing share the same alphabetic designation even if the feature is shown in less than all of the flexible containers. Similar features are structured similarly, operate similarly, and/or have the same function unless otherwise indicated by the drawings or this specification. Furthermore, particular features of one flexible container can replace corresponding features in another flexible container unless otherwise indicated by the drawings or this specification.

FIG. 1 shows a first flexible container 10 for containing a quantity of pourable product. The flexible container 10 is operable to contain a quantity of pourable product, such as powder 54, a liquid 56, a plurality of discrete pieces 58, or any combination thereof. The pourable product can be food product or non-edible product. With respect to possible alternative pourable food products, the pourable product in the first flexible container 10 can be a liquid such as ketchup or sauce or cream cheese, or a powder such as salt or pepper or other spices, or a plurality of discrete pieces such as candy pieces or crackers or potato chips. These exemplary pourable food products are set forth as examples and illustrations and not as limitations.

The first flexible container 10 is in the form of a bag 12. Alternative embodiments of the first flexible container 10 can take the form of a packet or a pouch or a sack. The bag 12 has a first closed end 14 and a second closed end 16 and a wall 18. The wall 18 extends between the first closed end 14 and the second closed end 16 to define a closed cavity. The bag 12 includes four corners defined at the first and second ends 14, 16. Alternative embodiments of the invention may include a bag having two corners at one end and an opposite end being rounded or two rounded ends.

The first flexible container 10 also includes a tearable score line 30 to define an intended opening 34 in the bag 12. The opening 34 is a display opening. The leader line extending from the numeral 34 is dashed in FIG. 1 because material has not been separated from the bag 12 to define the opening 34. The score line 30 is spaced from both ends 14, 16 and extends about a portion 42 of the wall 18 to isolate the portion 42 from a remainder of the bag 12. The path followed by the score line 30 is endless, without separate ends.

The first flexible container 10 can be opened by pinching the portion 42 and pinching another portion 52 of the wall 18 outside of the portion 42. The two pinched portions can be urged apart to tear the bag 12 along the score line 30. After removing the portion 42, the first flexible container 10 can function like a serving dish, such as a bowl or platter.

The exemplary bag 12 is formed from plastic and is multi-laminate. The score line 30 can be formed with a die or with a laser or with any other score line-forming method/device known in the art. The exemplary line 30 does not extend completely through the bag 12 to increase the likelihood that the pourable product in the bag 12 will remain fresh.

The exemplary score line 30 is exposed and directly graspable. The tearable score line 30 extends along a closed or endless path and is exposed along all of the closed path. The tearable score line 30 is the only link between the first portion 52 and the second portion 42. As a result, the bag 12 can be permanently converted into a serving dish such a bowl or a platter. The bag 12 requires no extraneous overlay or other link between the portions 42, 52, to render the portion 42 a re-closable lid member to the bag 12, making the bag 12 less costly and easier to open than bags in the prior art.

As set forth above, the flexible container 10 can contain a pourable food product. If the food product is a liquid, the liquid is flowable through the aperture or opening formed when the tearable score line 30 is torn and the second portion 42 is permanently separated from the first portion 52. In one example, the bag 12 may contain a quantity of ketchup desirable for an event, such as a picnic. Instead of transporting a large plastic bottle of ketchup, a user may acquire a bag 12 with a smaller quantity of ketchup. The bag 12 can be opened like a serving dish by removing the portion 42 from the portion 52, the ketchup evacuated from the bag 12 through a display opening 34 during the event, and the bag 12 disposed after the event.

If the quantity of pourable food product is a plurality of discrete pieces, the second portion 42 can be larger than each of the plurality of discrete pieces. In one example, the bag 12 may contain a quantity of potato chips desirable for an event, such as a party. The portion 42 can be sized to allow a user to grasp a plurality of potato chips at one time and evacuate the potato chips from the bag 12.

The path followed by the tearable score line 30 includes first and second hastate portions 60, 62. Alternative embodiments of the invention may only include one hastate portion or may not include a single hastate portion. The hastate portions 60, 62 provide locations to initiate a tear of the score line 30. A user of the bag 12 can grasp one side of the score line 30, the portion 52, with one hand and grasp the other side of the score line 30, the portion 42, with the other hand. Pinching the grasped portions 42 and 52 and pulling apart can result in the score line 30 being torn.

Figure 2:
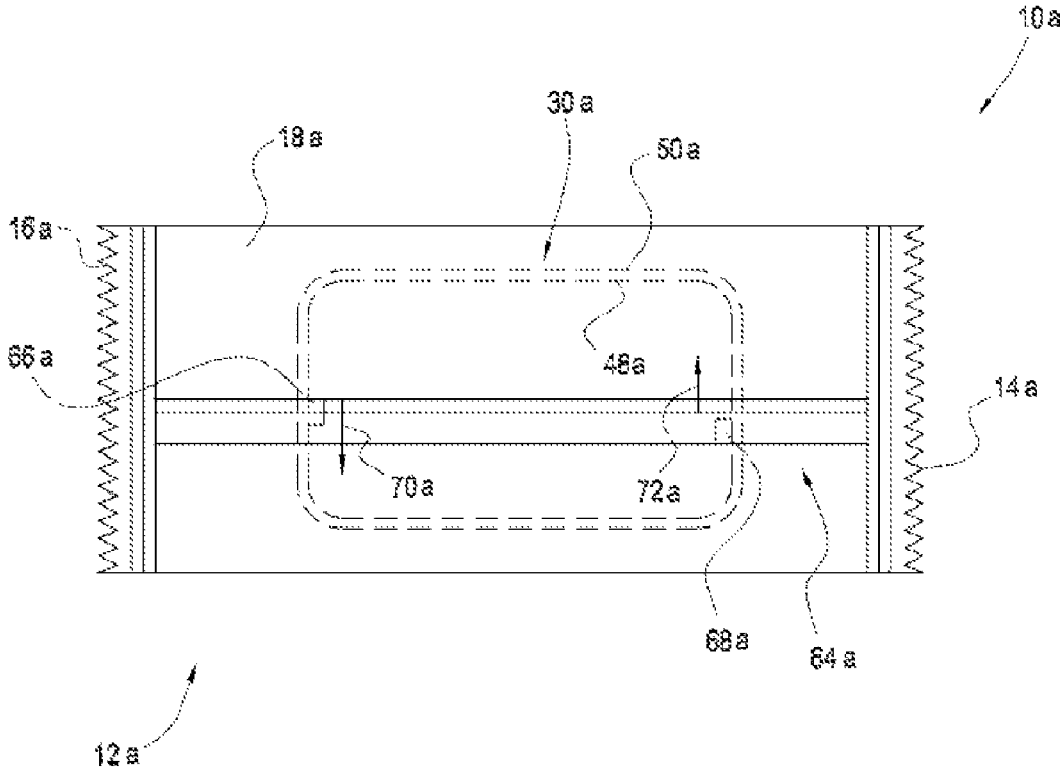
FIG. 2 is a top view of a flexible container according to a second embodiment of the invention.

FIG. 2 shows a fourth flexible container 10*a* operable to contain a quantity of pourable product. The flexible container 10*a* is the form of a bag 12*a* having a first closed end 14*a* and a second closed end 16*a* extending substantially parallel to the first closed end 14*a*. The bag 12*a* also includes a wall 18*a* extending between the first closed end 14*a* and the second closed end 16*a* to define a closed cavity. The bag 12*a* also includes a tearable score line 30*a* defining an intended opening directly to the closed cavity. The tearable score line 30*a* includes a primary score line 48*a* and back-up score line 50*a* closely spaced to one another and extending substantially parallel to one another along an endless path in an outer surface of the bag. The primary score line 48*a* and back-up score line 50*a* enhance control over the tear of the bag 12*a*. The line 48*a* is the intended line of tear. However, during tearing, the line of tear may depart from the line 48*a*. In such a circumstance, the line of tear will intersect the line 50*a* and follow the line 50*a*. As a result, the likelihood of over-tearing is reduced.

The flexible container 10*a* also includes a longitudinal seam 64*a* closing the wall 18*a* transverse to the first closed end 14*a* and the second closed end 16*a*. The tearable score line 30*a* crosses the longitudinal seam 64*a*. Thus, the score line 30*a* is disposed on the side of the bag 12*a* that is generally the back side. The score line 30 of the first exemplary flexible container 10 is disposed on a side of the bag 12 that is generally a front side. First and second tabs 66*a*, 68*a* are formed in the longitudinal seam 64*a*. The tabs 66*a*, 68*a* are contiguous with the tearable score line 30*a* and can be engaged to initiate a tear in the score line 30*a*. The tabs 66*a*, 68*a* can be aligned with the primary score line 48*a* and can be helpful to accomplish complete tearing of the score line 30*a* across the seam 64*a*. The tab 66*a* can be pulled in a direction 70*a* to tear the score line 30*a* across the seam 64*a* and the tab 68*a* can be pulled in a direction 72*a* to tear the score line 30*a* across the seam 64*a*.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What can be claimed is:

1. A flexible container for containing a quantity of pourable product comprising:

a bag having a first closed end and a second closed end and a wall extending between said first closed end and said second closed end to define a closed cavity; and a tearable score line extending along an endless path and partially through said bag and defining an intended opening directly to said closed cavity, said tearable score line dividing said wall into a first portion disposed outwardly of said tearable score line and engaged with both of said first closed end and said second closed end and a second portion disposed inwardly of said tearable score line and being completely removable from said first portion along said tearable score line and spaced from both of said first closed end and said second closed end, and wherein said tearable score line is exposed and directly graspable such that said bag is operable to function as a dish when said second portion is completely removed;

wherein said tearable score line includes a primary score line and back-up score line closely spaced to one another and extending substantially parallel to one another, wherein each of said primary score line and said back-up score line extend along an endless path in an outer surface of said bag and are capable of operating independently from each other.

2. The flexible container of claim 1 wherein said tearable score line is the only link between said first portion and said second portion.

3. The flexible container of claim 1 further comprising:

a quantity of pourable food product disposed in said closed cavity.

4. The flexible container of claim 3 wherein said pourable food product is a liquid.

5. The flexible container of claim 3 wherein said pourable food product is further defined as a plurality of discrete pieces and wherein said second portion is larger than each of said plurality of discrete pieces.

6. The flexible container of 1 wherein said tearable score line is exposed along substantially all of said endless path.

7. The flexible container of claim 1 wherein said bag further comprises:

a longitudinal seam closing said wall and extending transverse to said first and second closed ends, wherein said tearable score line crosses said longitudinal seam at least once.

8. The flexible container of claim 7 wherein said bag further comprises:

at least one tab formed in said longitudinal seam and contiguous with said tearable score line.

9. The flexible container of claim 1 wherein said tearable score line extends along a path having at least one hastate portion.

10. The flexible container of claim 1 wherein said tearable score line extends along a path having at plurality of hastate portions.

11. The flexible container of claim 1 wherein said back-up score line is disposed outwardly of said primary score line, and said primary score line provides an intended line of tear and said back-up score line provides a secondary line of tear if the intended line of tear departs from said primary score line.

12. The flexible container of claim 1 wherein said tearable score line extends along a rounded path.

* * * * *